US010325735B2

(12) United States Patent
Yen et al.

(10) Patent No.: US 10,325,735 B2
(45) Date of Patent: Jun. 18, 2019

(54) KEY SUPPORT MECHANISM AND KEY MODULE

(71) Applicants: LITE-ON ELECTRONICS (GUANGZHOU) LIMITED, Guangzhou (CN); Lite-On Technology Corporation, Taipei (TW)

(72) Inventors: Ming-Fu Yen, Taipei (TW); Hsiang-Sheng Chuang, Taipei (TW)

(73) Assignees: LITE-ON ELECTRONICS (GUANGZHOU) LIMITED, Guangzhou (CN); Lite-On Technology Corporation, Taipei (TW)

( * ) Notice: Subject to any disclaimer, the term of this patent is extended or adjusted under 35 U.S.C. 154(b) by 0 days.

(21) Appl. No.: 15/867,753

(22) Filed: Jan. 11, 2018

(65) Prior Publication Data

US 2019/0096602 A1 Mar. 28, 2019

(30) Foreign Application Priority Data

Sep. 22, 2017 (CN) ..... 2017 1 0863746

(51) Int. Cl.
*H01H 13/14* (2006.01)
*H01H 13/20* (2006.01)
*H01H 13/10* (2006.01)

(52) U.S. Cl.
CPC ..... *H01H 13/20* (2013.01); *H01H 13/10* (2013.01); *H01H 13/14* (2013.01); *H01H 2233/07* (2013.01)

(58) Field of Classification Search
CPC .... H01H 3/122; H01H 3/125; H01H 13/7065; H01H 13/14; H01H 2233/002; H01H 2215/006; H01H 2217/012; H01H 2237/00; H01H 3/12; H01H 13/12
USPC ..... 200/5 A, 341–344
See application file for complete search history.

(56) References Cited

U.S. PATENT DOCUMENTS

2014/0318942 A1* 10/2014 Takemae ..... H01H 3/125 200/5 A

* cited by examiner

*Primary Examiner* — Ahmed M Saeed
(74) *Attorney, Agent, or Firm* — JCIPRNET

(57) ABSTRACT

The invention provides a key support mechanism and a key module. The key support mechanism is adapted to be disposed between a base plate and a keycap and includes two scissor structures and a first connecting member. The two scissor structures include two first support frames and two second support frames respectively pivotally connected to the two first support frames. Each of the first support frames includes a first side and a second side opposite to each other, a first fixing part located on the first side, and a second fixing part located on the second side. Each of the second support frames includes a third side and a fourth side opposite to each other, a third fixing part located on the third side, and a fourth fixing part located on the fourth side. The two first fixing parts and the two third fixing parts are respectively adapted to be fixed to the keycap, and the two second fixing parts and the two fourth fixing parts are respectively adapted to be fixed to the base plate. The first connecting member is fixed and connected to the two first support frames and are close to the two first sides, such that the two first support frames of the two scissor structures are linked to each other.

8 Claims, 11 Drawing Sheets

KEY SUPPORT MECHANISM AND KEY MODULE

CROSS REFERENCE TO RELATED APPLICATION

This application claims the priority benefit of China application serial no. 201710863746.9, filed on Sep. 22, 2017. The entirety of the above-mentioned patent application is hereby incorporated by reference herein and made a part of specification.

BACKGROUND OF THE INVENTION

Field of the Invention

The invention relates to a key support mechanism and a key module, and in particular, to a key support mechanism and a key module applicable to a multiple unit key.

Description of Related Art

Currently, portable electronic devices (e.g., laptops) are generally being developed to thin down, and therefore, keyboards equipped on these thin laptops are also being developed to thin down. However, in a thin keyboard, space in a key is limited, and a thin keycap is prone to deformation. If a user only presses one of the edges of certain keys (e.g., a multiple unit key, which is longer than a general standard one unit key in a length direction, such as a space bar), it is possible that only this edge is pressed down and the opposite edge on this key is not moved downward jointly. As a result, a switch located right below the center of the key cannot be triggered.

How to move a key (e.g., a multiple unit key) downward in its entirety when only one of the edges of the key is pressed down and how to configure this key to be easy to assemble, incur low costs, and produce little noise when being pressed are one of the important issues that people skilled in the art seek to resolve.

SUMMARY OF THE INVENTION

The invention provides a key support mechanism that causes a key to move downward in its entirety when one of edges of a keycap is pressed downward. The key support mechanism is structurally simple, incurs low costs, and produces little noise when being pressed.

The invention provides a key module including the foregoing key support mechanism.

A key support mechanism of the invention is adapted to be disposed between a base plate and a keycap. The key support mechanism includes two scissor structures. The two scissor structures include two first support frames, two second support frames, and a first connecting member. Each of the first support frames includes a first side and a second side opposite to each other, a first fixing part located on the first side, and a second fixing part located on the second side, wherein the two first fixing parts are respectively adapted to be fixed to the keycap, and the two second fixing parts are respectively adapted to be fixed to the base plate. The two second support frames are respectively pivotally connected to the two first support frames, and each of the second support frames includes a third side and a fourth side opposite to each other, a third fixing part located on the third side, and a fourth fixing part located on the fourth side, wherein the two third fixing parts are respectively adapted to be fixed to the keycap, and the two fourth fixing parts are respectively adapted to be fixed to the base plate. The first connecting member is fixed and connected to the two first support frames and is located close to the two first sides, such that the two first support frames of the two scissor structures are linked to each other.

In an embodiment of the invention, each of the first support frames includes a first slot, and each of the second support frames is adapted to be pivotally rotated into the first slot of the corresponding first support frame.

In an embodiment of the invention, each of the second support frames includes a second slot, and each of the first support frames is adapted to be pivotally rotated into the second slot of the corresponding second support frame.

In an embodiment of the invention, the key support mechanism further includes a second connecting member connected to the two second support frames and located close to the two third sides, such that the two second support frames of the two scissor structures are linked to each other.

In an embodiment of the invention, the two first support frames and the first connecting member are integrally formed by sintering from a powder sintering material, or the two first support frames and the first connecting member are an integral metal member.

A key module of the invention includes a base plate, a circuit membrane, an elastic member, a key support mechanism, and a keycap. The circuit membrane is disposed on the base plate and includes a switch. The elastic member is disposed on the switch. The key support mechanism is disposed on the circuit membrane. The key support mechanism includes two scissor structures, wherein the elastic member is located between the two scissor structures. The two scissor structures include two first support frames, two second support frames, and a first connecting member. Each of the first support frames includes a first side and a second side opposite to each other, a first fixing part located on the first side, and a second fixing part located on the second side, wherein the two second fixing parts are respectively fixed to the base plate. The two second support frames are respectively pivotally connected to the two first support frames, and each of the second support frames includes a third side and a fourth side opposite to each other, a third fixing part located on the third side, and a fourth fixing part located on the fourth side, wherein the two fourth fixing parts are respectively fixed to the base plate. The first connecting member is fixed and connected to the two first support frames and is located close to the two first sides, such that the two first support frames of the two scissor structures are linked to each other. The keycap covers the elastic member and the key support mechanism, wherein the two first fixing parts of the two first support frames and the two third fixing parts of the two second support frames are respectively fixed to the keycap.

In an embodiment of the invention, each of the first support frames includes a first slot, and each of the second support frames is adapted to be pivotally rotated into the first slot of the corresponding first support frame.

In an embodiment of the invention, each of the second support frames includes a second slot, and each of the first support frames is adapted to be pivotally rotated into the second slot of the corresponding second support frame.

In an embodiment of the invention, the key support mechanism further includes a second connecting member connected to the two second support frames and located close to the two third sides, such that the two second support frames of the two scissor structures are linked to each other.

In an embodiment of the invention, the two first support frames and the first connecting member are integrally formed by sintering from a powder sintering material, or the two first support frames and the first connecting member are an integral metal member.

In light of the above, the key support mechanism of the key module of the invention includes the two scissor structures. The key support mechanism connects the two first support frames of the two scissor structures through the first connecting member, and the first connecting member is close to the two first sides of the two first support frames, such that the two first sides of the two first support frames connected to the keycap are linked to each other. Accordingly, when one of the edges of the keycap is pressed downward, the first side of the first support frame below this edge is moved downward, which causes the first connecting member to move downward jointly and drives the first side of the first support frame below the other edge to move downward. Therefore, the two first support frames of the two scissor structures move downward together such that the keycap can move together in its entirety. As a result, the keycap can press downward the elastic member located between the two scissor structures and trigger the switch. The key support mechanism of the key module of the invention exhibits advantages of structural simplicity, low costs, and ease of assembly. Moreover, since the first connecting member is fixed to the two first support frames, the first connecting member does not move relatively to the two first support frames. When the key module is pressed, the first connecting member does not hit the keycap or the base plate due to unwanted shaking and cause noise, and a more comfortable use experience is created.

To provide a further understanding of the aforementioned and other features and advantages of the disclosure, exemplary embodiments, together with the reference drawings, are described in detail below.

DESCRIPTION OF THE EMBODIMENTS

Figure 1:
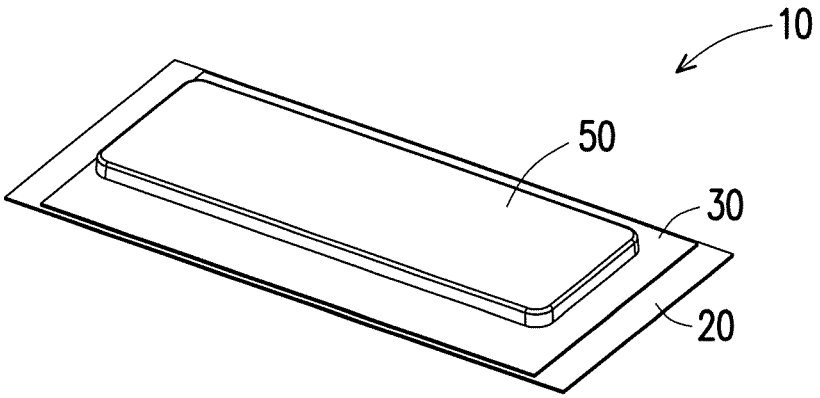
FIG. 1 is a schematic diagram illustrating a key module according to an embodiment of the invention.

FIG. 1 is a schematic diagram illustrating a key module according to an embodiment of the invention. Referring to FIG. 1 first, FIG. 1 schematically illustrates a key module 10 as one single key. In fact, the key module 10 may be one single key or one of the keys in a keyboard, e.g., a multiple unit key such as a space bar, of which a length is greater than a length of a standard one unit key. However, the type and the form of the key are not limited hereto. When one of edges of a keycap 50 of the key module 10 of the present embodiment is pressed down, the keycap 50 is moved downward in its entirety rather than being moved downward only at one single edge as in a form of a seesaw. Therefore, even if a user only presses one of the edges of the keycap 50, a switch 32 (labeled in FIG. 2) of the key module 10 can still be triggered. A detailed description in this regard will be provided below.

Figure 2:
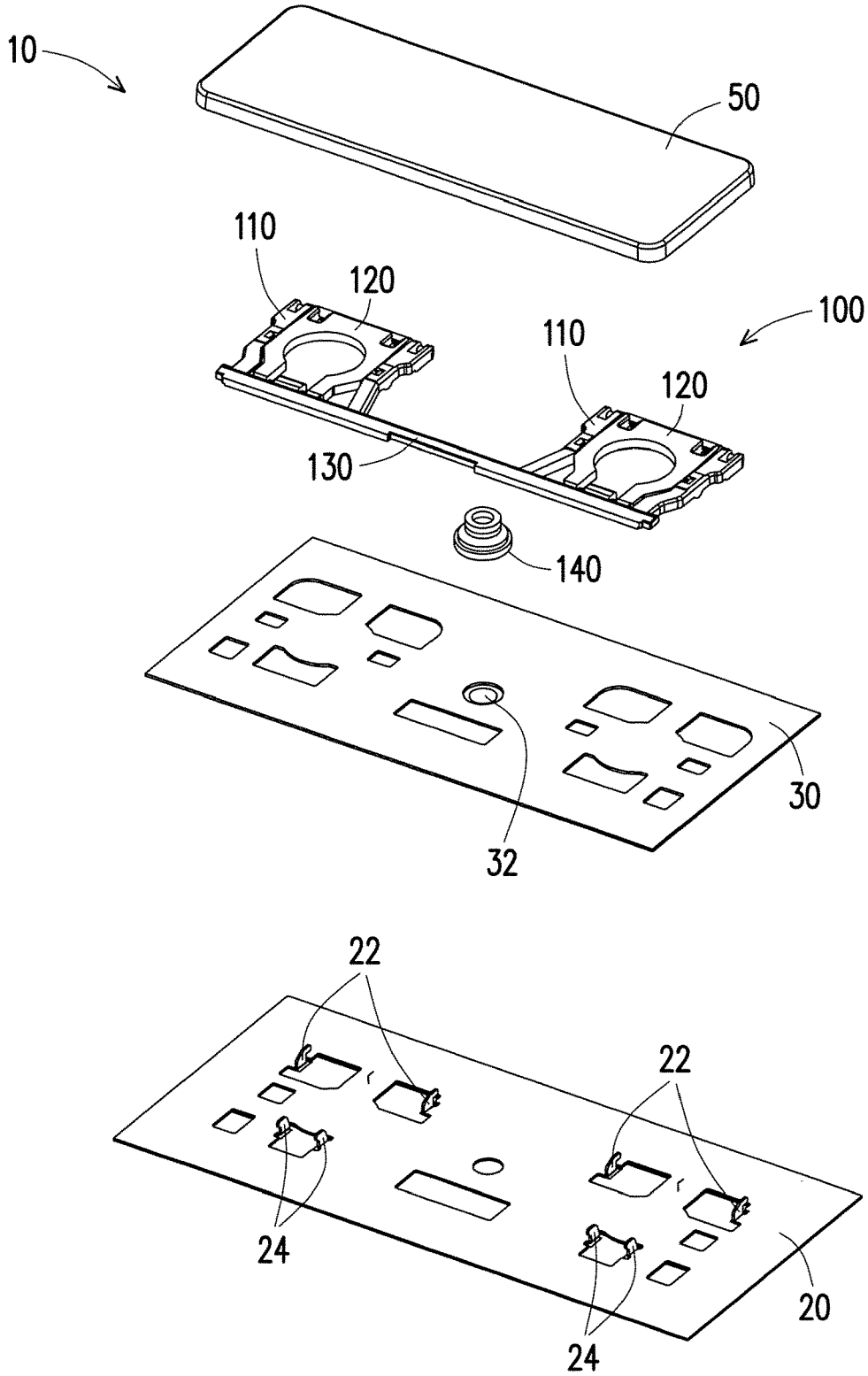
FIG. 2 is an exploded schematic diagram illustrating the key module of FIG. 1.
Figure 3:
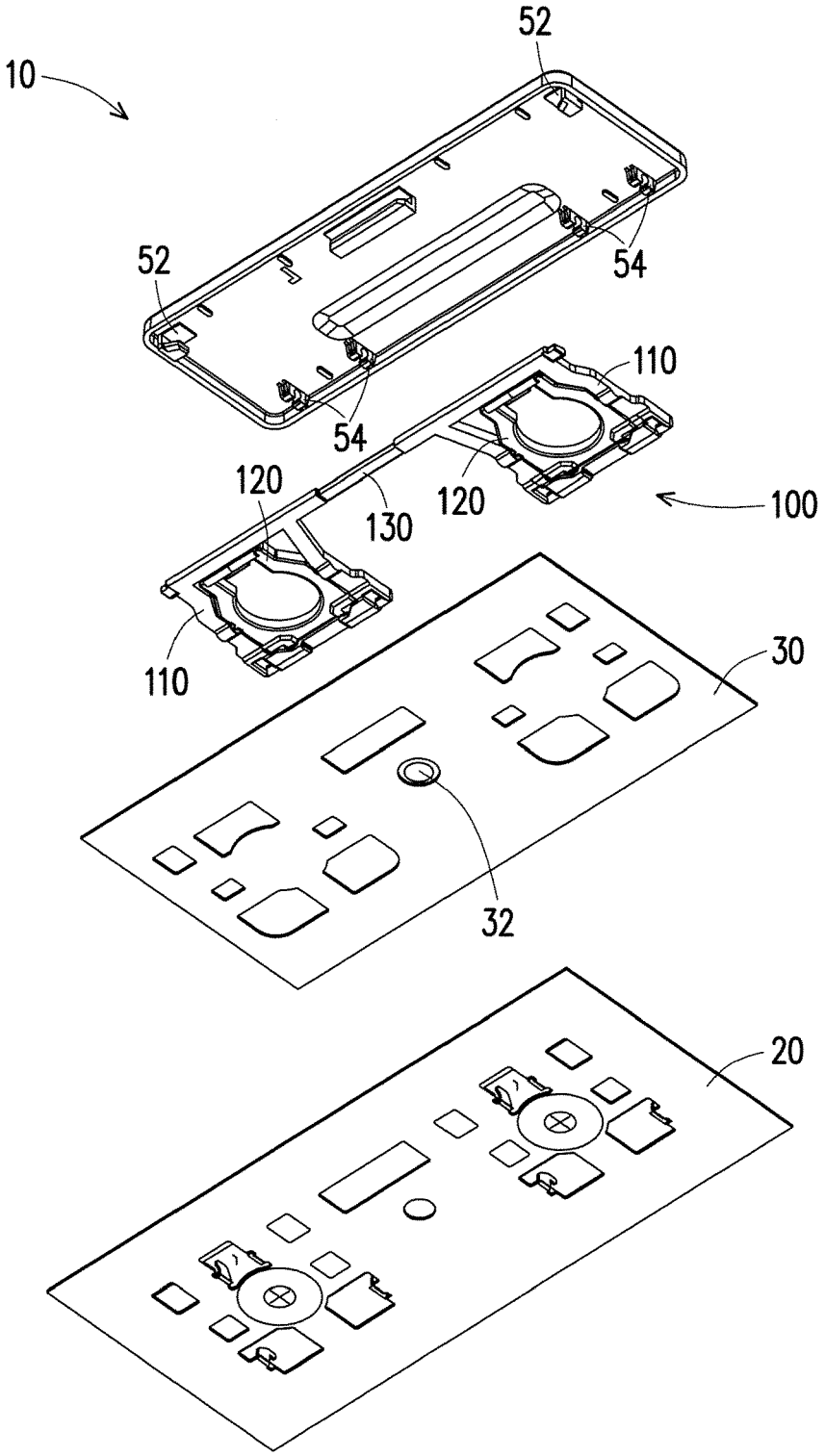
FIG. 3 is a schematic diagram illustrating FIG. 2 from another angle of view.
Figure 4:
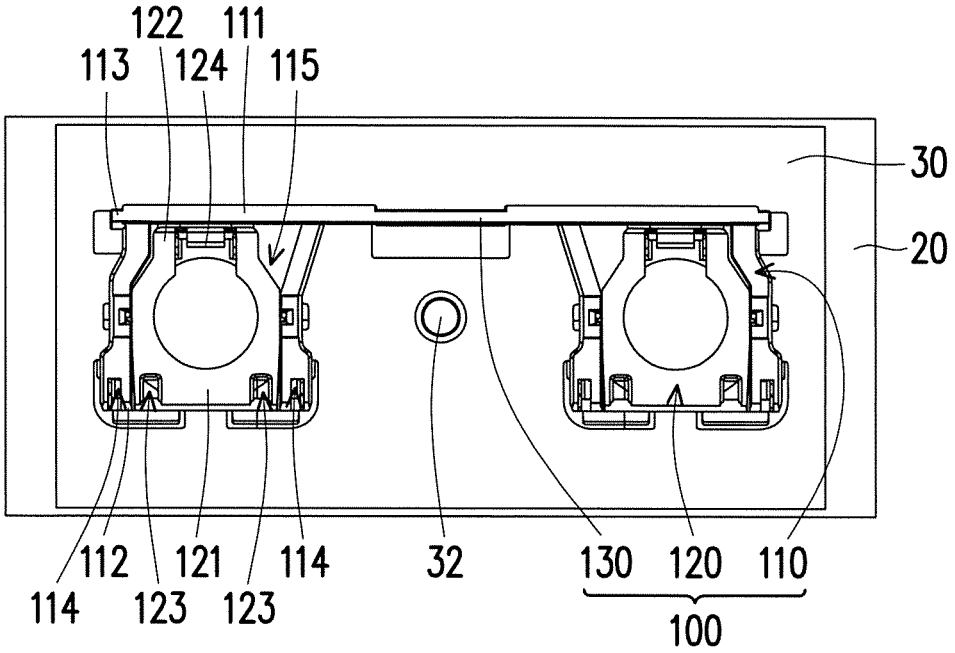
FIG. 4 is a schematic diagram illustrating a top view of the key module of FIG. 1 with a keycap concealed.

FIG. 2 is an exploded schematic diagram illustrating the key module 10 of FIG. 1. FIG. 3 is a schematic diagram illustrating FIG. 2 from another angle of view. FIG. 4 is a schematic diagram illustrating a top view of the key module 10 of FIG. 1 with the keycap 50 concealed. It shall be noted that an elastic member 140 is not shown in FIG. 3 and FIG. 4, but a reader shall still be able to learn a form and a position relation of the elastic member 140 from FIG. 2.

Referring to FIG. 2 to FIG. 4, the key module 10 of the present embodiment includes a base plate 20, a circuit membrane 30, the elastic member 140, a key support mechanism 100, and the keycap 50. In the present embodiment, as shown in FIG. 2, the base plate 20 includes a plurality of first base plate fixing parts 22 and a plurality of second base plate fixing parts 24. The circuit membrane 30 is disposed on the base plate 20 and includes the switch 32. The elastic member 140 is disposed on the switch 32. The elastic member 140 may be a metal dome, a rubber dome, a magnetic suction actuator, or another actuator that allows a press touch. The key support mechanism 100 is disposed on the circuit membrane 30 and is located on two sides of the elastic member 140. The keycap 50 covers the elastic member 140 and the key support mechanism 100. As shown in FIG. 3, an inner bottom surface of the keycap 50 includes a plurality of first keycap fixing parts 52 and a plurality of second keycap fixing parts 54.

Figure 5:
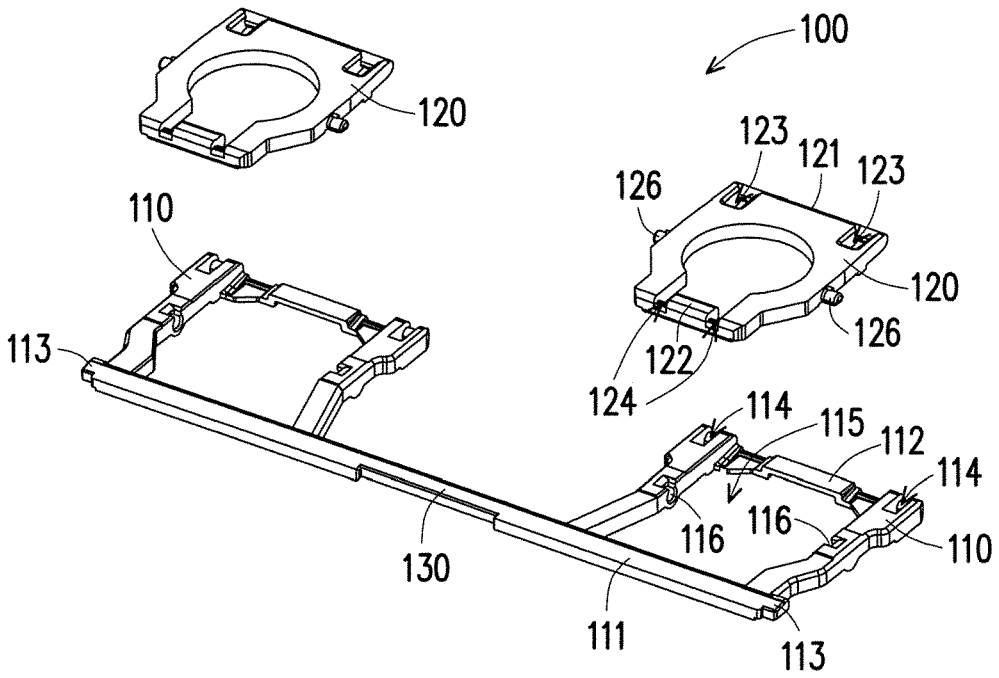
FIG. 5 is an exploded schematic diagram illustrating a key support mechanism of the key module of FIG. 1.
Figure 6:
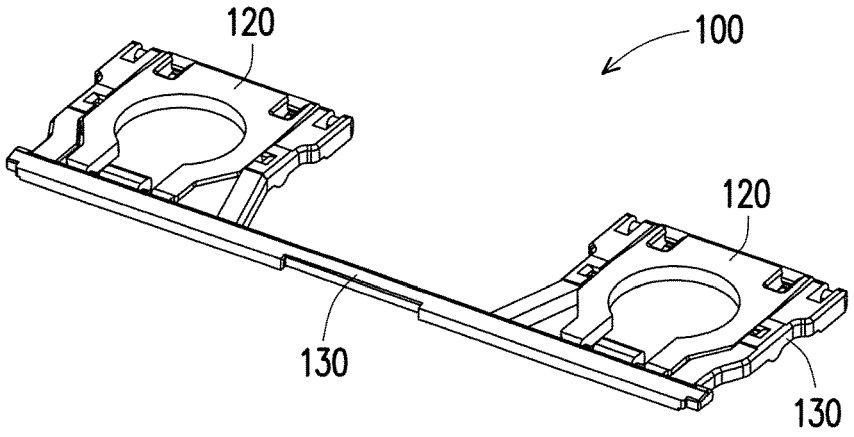
FIG. 6 is an assembly schematic diagram illustrating the key support mechanism of FIG. 5.
Figure 7:
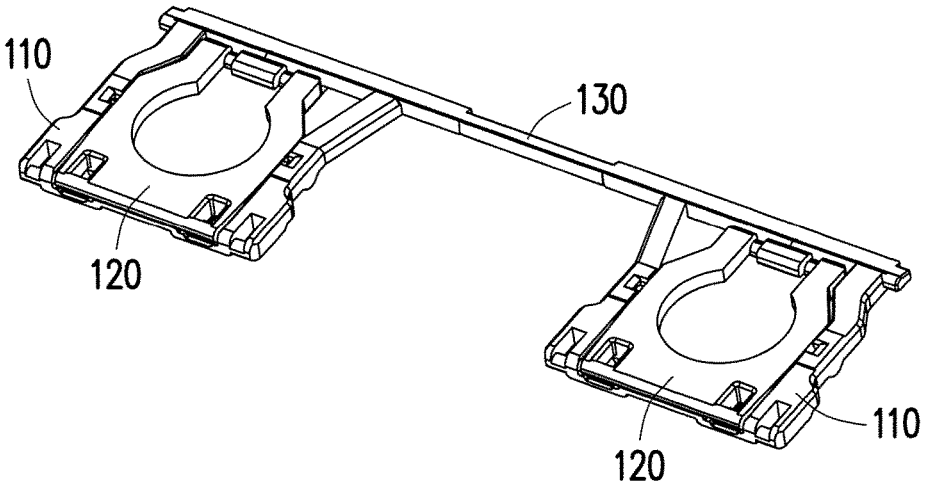
FIG. 7 is a schematic diagram illustrating the key support mechanism of FIG. 6 from another angle of view.
Figure 8:
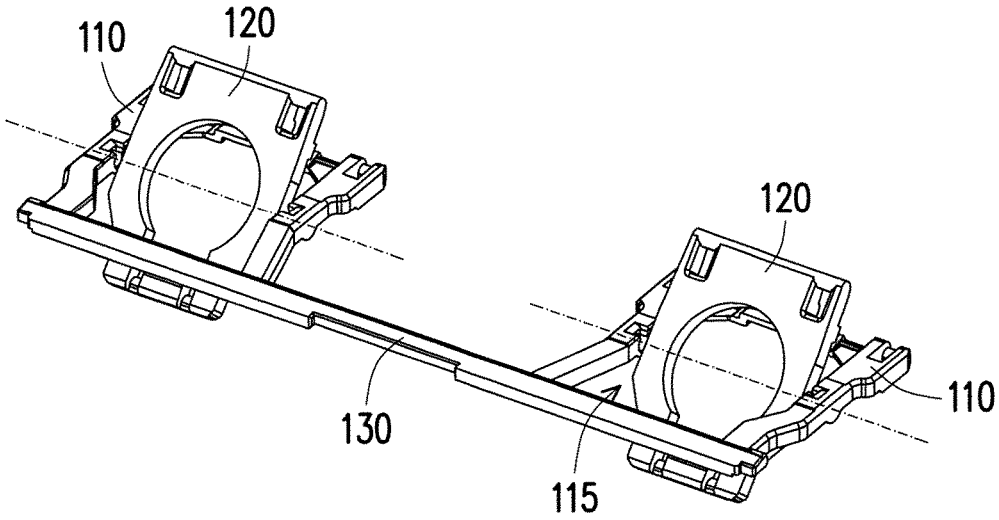
FIG. 8 and FIG. 9 are respectively schematic diagrams illustrating pivotal rotation of second support frames relative to first support frames of the key support mechanism of FIG. 6 and FIG. 7.
Figure 9:
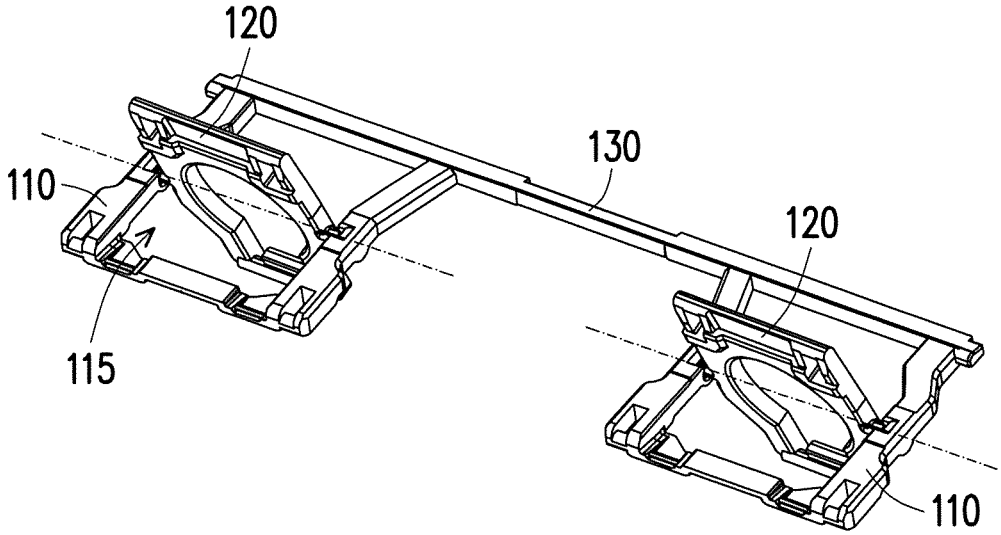

FIG. 5 is an exploded schematic diagram illustrating the key support mechanism 100 of the key module 10 of FIG. 1. FIG. 6 is an assembly schematic diagram illustrating the key support mechanism 100 of FIG. 5. FIG. 7 is a schematic diagram illustrating the key support mechanism 100 of FIG. 6 from another angle of view. FIG. 8 and FIG. 9 are respectively schematic diagrams illustrating pivotal rotation of second support frames 120 relative to first support frames 110 of the key support mechanism 100 of FIG. 6 and FIG. 7.

Referring to FIG. 5 to FIG. 9, in the present embodiment, as an example, the key module 10 is a multiple unit key. To provide excellent support, the key support mechanism 100 includes two scissor structures (see FIG. 8 and FIG. 9). It shall be noted that, in other embodiments, the key support mechanism 100 of the present embodiment may also be applied to a standard one unit key once its proportion is changed, and its application is not limited to the multiple unit key. As shown in FIG. 5, the two scissor structures include two first support frames 110, two second support frames 120, and a first connecting member 130 fixed and connected to the two first support frames 110. The two second support frames 120 are respectively pivotally connected to the two first support frames 110. More specifically, pivot shafts 126 of the second support frame 120 are pivotally connected to pivot holes 116 of the first support frame 110, and the second support frame 120 may rotate relatively to the first support frame 110 to create a form of a scissor leg. Of course, in other embodiments, the pivot shafts 126 may also be located on the first support frame 110, and the pivot holes 116 may also be located on the second support frame 120, which are not limited hereto.

In the present embodiment, the first support frame 110 is, as an example, outer scissors of the scissor structure, and the second support frame 120 is, as an example, inner scissors of the scissor structure. However, the relationship between the first support frame 110 and the second support frame 120 is not limited hereto. The first support frame 110 includes a first slot 115, and, as shown in FIG. 6, the corresponding second support frame 120 is adapted to be pivotally rotated into the first slot 115 of the first support frame 110.

As shown in FIG. 5, each of the first support frames 110 includes a first side 111 and a second side 112 opposite to each other, a first fixing part 113 located on the first side 111, and a second fixing part 114 located on the second side 112. The first fixing part 113 of the first support frame 110 is fixed to the first keycap fixing part 52 of the keycap 50, and the second fixing part 114 of the first support frame 110 is fixed to the first base plate fixing part 22 of the base plate 20. In the present embodiment, the first fixing part 113 of the first support frame 110 and the first keycap fixing part 52 of the keycap 50 may be a combination of a hook and a tenon, and the second fixing part 114 of the first support frame 110 and the first base plate fixing part 22 of the base plate 20 may be a combination of a hook and a tenon, but they are not limited hereto.

Each of the second support frames 120 includes a third side 121 and a fourth side 122 opposite to each other, a third fixing part 123 located on the third side 121, and a fourth fixing part 124 located on the fourth side 122. The third fixing part 123 of the second support frame 120 is fixed to the second keycap fixing part 54 of the keycap 50, and the fourth fixing part 124 of the second support frame 120 is fixed to the second base plate fixing part 24 of the base plate 20. In the present embodiment, the third fixing part 123 of the second support frame 120 and the second keycap fixing part 54 of the keycap 50 may be a combination of a hook and a tenon, and the fourth fixing part 124 of the second support frame 120 and the second base plate fixing part 24 of the base plate 20 may be a combination of a hook and a tenon, but they are not limited hereto.

In the present embodiment, the first connecting member 130 is fixed to a portion of the two first support frames 110 close to the two first sides 111, such that the two first support frames 110 of the two scissor structures are linked to each other. Accordingly, when an edge on the keycap 50 corresponding to the first side 111 of one of the first support frames 110 is pressed down, the first side 111 of the first support frame 110 below this edge is moved downward, which causes the first connecting member 130 to move downward jointly and drives the first side 111 of the first support frame 110 below the other edge to move downward. Therefore, the two first support frames 110 of the two scissor structures move together such that the keycap 50 can move together lengthwise. As a result, the keycap 50 can press downward the elastic member 140 located between the two scissor structures and trigger the switch 32.

Even if the user presses a corner on the keycap 50 corresponding to the third side 121 of one of the second support frames 120, since the width dimension of the key is small, the press is still linked to the opposite side (namely, the first side 111 of the first support frame 110), and similarly, the first support frame 110 can drive the first connecting member 130 and drive the other first support frame 110, such that the keycap 50 is moved downward in its entirety and triggers the switch 32.

It shall be mentioned that, in the present embodiment, in addition to linking the two first support frames 110 of the two scissor structures to each other through fixing the first connecting member 130 to the portion of the two first support frames 110 close to the two first sides 111, it is also possible to create a better structural strength in the two first support frames 110 and the first connecting member 130 through selection of materials so as to provide a better rigidity and create a better linking effect.

For example, the two first support frames 110 and the first connecting member 130 may be integrally formed by sintering from a powder sintering material. The powder sintering material may be selected from a metallic powder sintering material and a ceramic powder sintering material. The metallic powder sintering material is, for example, formed of one single metallic material or formed by blending multiple metallic powder materials, such as tungsten carbide, titanium alloys, ferroalloy materials (e.g., iron-nickel alloy), stainless steel powders (e.g., 304L stainless steel, 306 stainless steel, 440C stainless steel, and 17-4PH stainless steel), various alloy steels (e.g., SKD11 die steel and powder high-speed steel), and copper alloy powder materials, among other metallic powder sintering materials. The ceramic powder sintering material is, for example, zirconium oxide ($ZrO_2$), yttrium oxide ($Y_2O_3$), aluminium oxide ($Al_2O_3$), silicon nitride ($Si_3N_4$), silicon carbide (SiC), boron nitride (BN), etc. However, the type of material and the manufacturing method of the two first support frames 110 and the first connecting member 130 are not limited hereto. In other embodiments, the two first support frames 110 and the first connecting member 130 may also be an integrally formed metal member or plastic member.

The key support mechanism 100 of the key module 10 of the present embodiment is structurally simple, incurs low costs, and is easy to assemble. Moreover, since the first connecting member 130 is fixed to the two first support frames 110, the first connecting member 130 does not move relatively to the two first support frames 110. When the key module 10 is pressed, the first connecting member 130 does not hit the keycap 50 or the base plate 20 due to unwanted shaking and cause noise, and a more comfortable use experience is created.

In the text below, key support mechanisms 100*a*, 100*b*, 100*c*, 100*d* of other embodiments are described. It shall be noted that, in the embodiments below, components identical or similar to the previous embodiment will be labeled by the same or similar numerals and will not be repeatedly described. Descriptions will be made only for the differences among the different embodiments.

Figure 10:
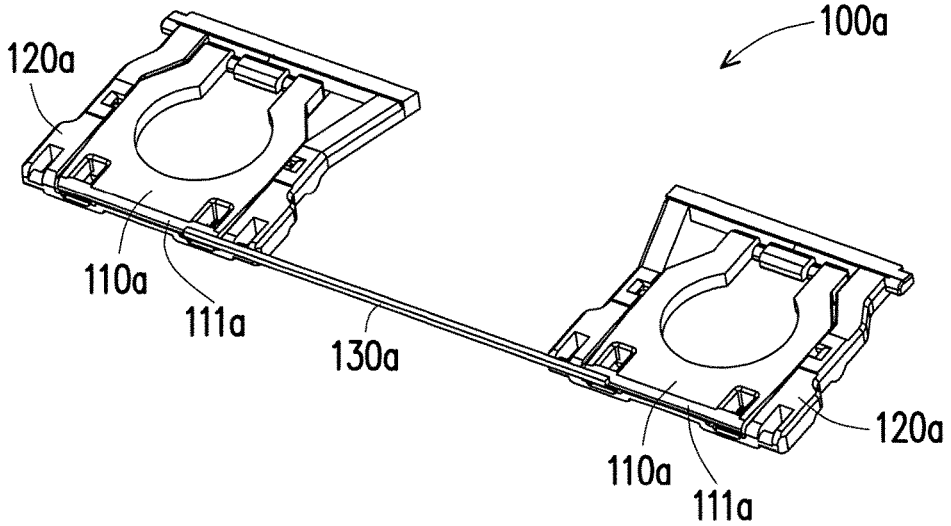
FIG. 10 is a schematic diagram illustrating a key support mechanism according to another embodiment of the invention.
Figure 11:
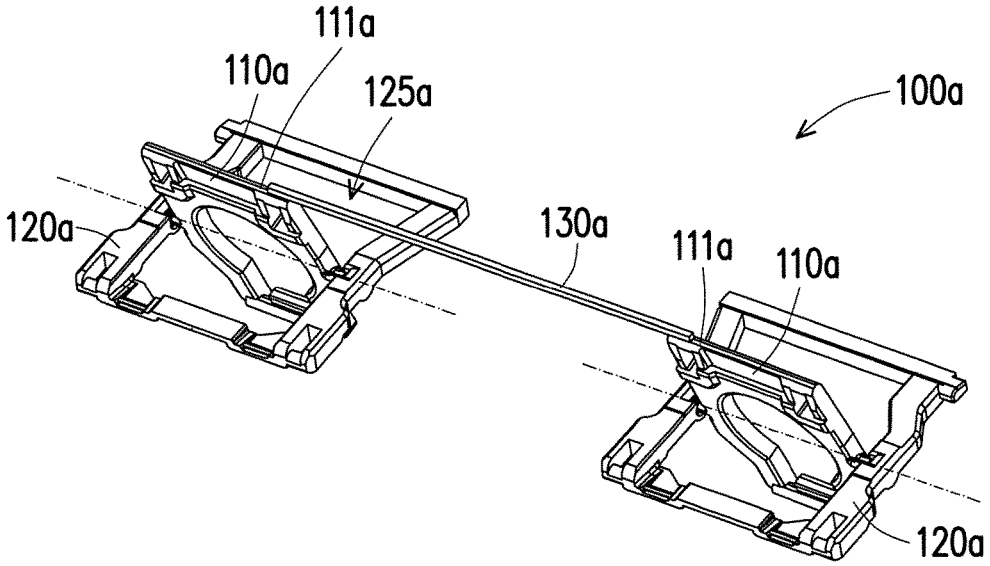
FIG. 11 is a schematic diagram illustrating pivotal rotation of second support frames relative to first support frames of the key support mechanism of FIG. 10.

FIG. 10 is a schematic diagram illustrating a key support mechanism 100*a* according to another embodiment of the invention. FIG. 11 is a schematic diagram illustrating pivotal rotation of second support frames 120*a* relative to first support frames 110*a* of the key support mechanism 100*a* of FIG. 10. Referring to FIG. 10 and FIG. 11, a main difference between the embodiment of FIG. 10 and the previous embodiment (FIG. 7) lies in that, in the previous embodiment, the first support frame 110 is, as an example, the outer scissors of the scissor structure, and the second support frame 120 is, as an example, the inner scissors of the scissor structure. In other words, the first connecting member 130 is connected to the two outer scissors. In the present embodiment, the first support frame 110*a* is, as an example, inner scissors of the scissor structure, and the second support frame 120*a* is, as an example, outer scissors of the scissor structure. In other words, the first connecting member 130*a* is connected to the two inner scissors. Therefore, in the present embodiment, the second support frame 120*a* functioning as the outer scissors includes a second slot 125*a*, and the first support frame 110*a* functioning as the inner scissors is pivotally rotated into the second slot 125*a* of the corresponding second support frame 120*a*.

In the present embodiment, the first connecting member 130*a* is connected to a first side 111*a* of the first support frame 110*a* functioning as the inner scissors. Similarly, when an edge on the first side 111*a* of one of the first support frames 110*a* is pressed down, the first connecting member 130*a* is caused to move downward jointly and drive the first side 111*a* of the other first support frame 110*a* to move downward. Therefore, the two first support frames 110*a* of the two scissor structures move together such that the keycap 50 (labeled in FIG. 2) can move downward in its entirety and trigger the switch 32 (labeled in FIG. 2).

Figure 12:
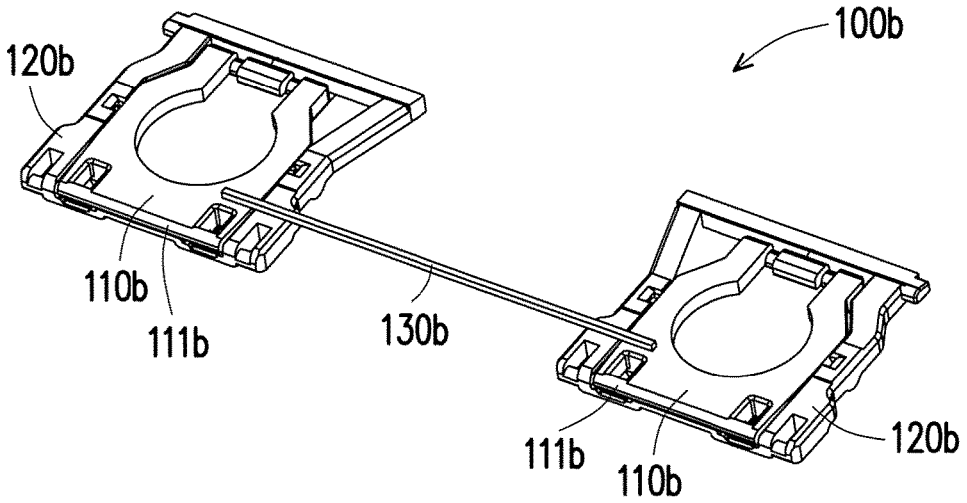
FIG. 12 is a schematic diagram illustrating a key support mechanism according to another embodiment of the invention.
Figure 13:
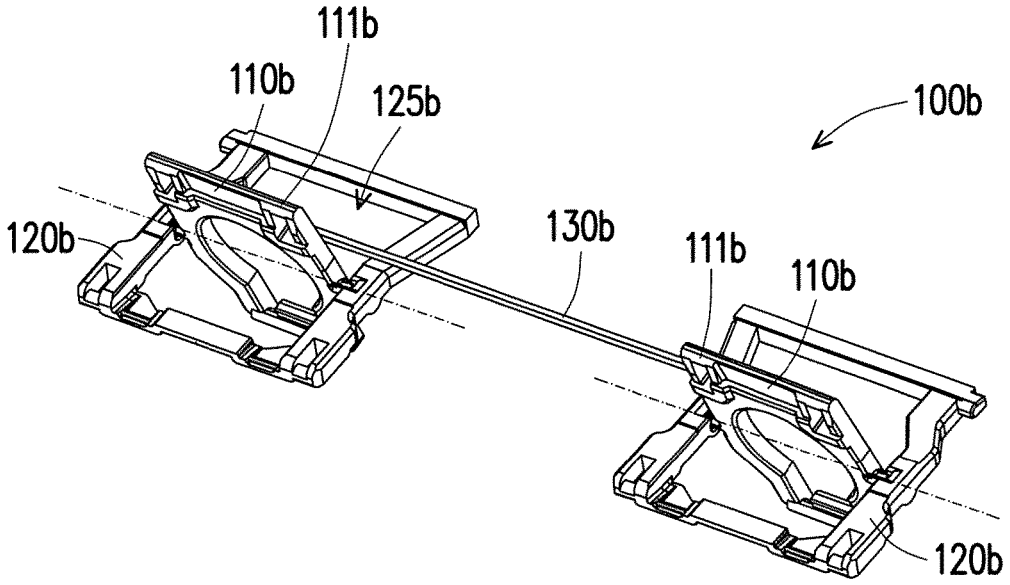
FIG. 13 is a schematic diagram illustrating pivotal rotation of second support frames relative to first support frames of the key support mechanism of FIG. 12.

FIG. 12 is a schematic diagram illustrating a key support mechanism 100*b* according to another embodiment of the invention. FIG. 13 is a schematic diagram illustrating pivotal rotation of second support frames 120*b* relative to first support frames 110*b* of the key support mechanism 100*b* of FIG. 12. Referring to FIG. 12 and FIG. 13, a main difference between the embodiment of FIG. 12 and the embodiment of FIG. 10 lies in the positions at which the first connecting members 130*a*, 130*b* are connected to the first support frames 110*a*, 110*b*. In FIG. 10, the first connecting member 130*a* is connected to the first side 111*a* of the first support frame 110*a* functioning as the inner scissors. In the present embodiment, the first connecting member 130*b* is connected to an upper surface of the first support frame 110*b* functioning as the inner scissors.

It shall be mentioned that since the first connecting member 130*b* is connected to the upper surface of the first support frame 110*b*, a corresponding portion on a lower surface of the keycap 50 (not illustrated) may be relatively indented to receive the first connecting member 130*b*.

Figure 14:
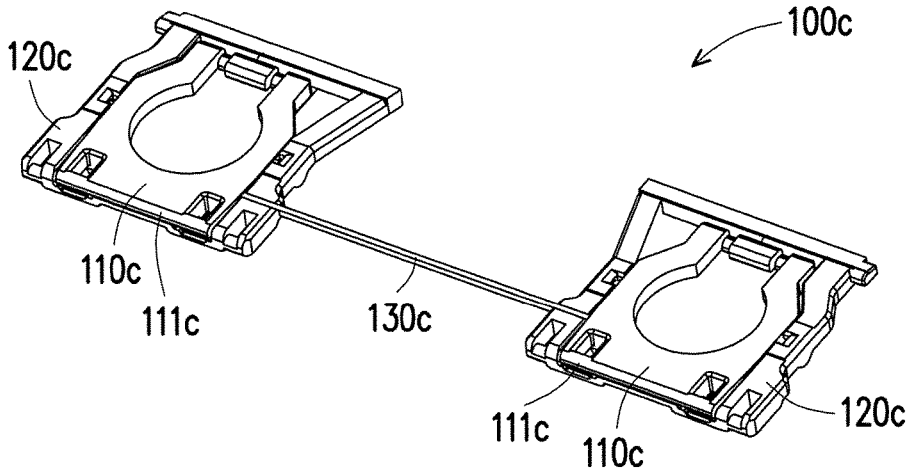
FIG. 14 is a schematic diagram illustrating a key support mechanism according to another embodiment of the invention.
Figure 15:
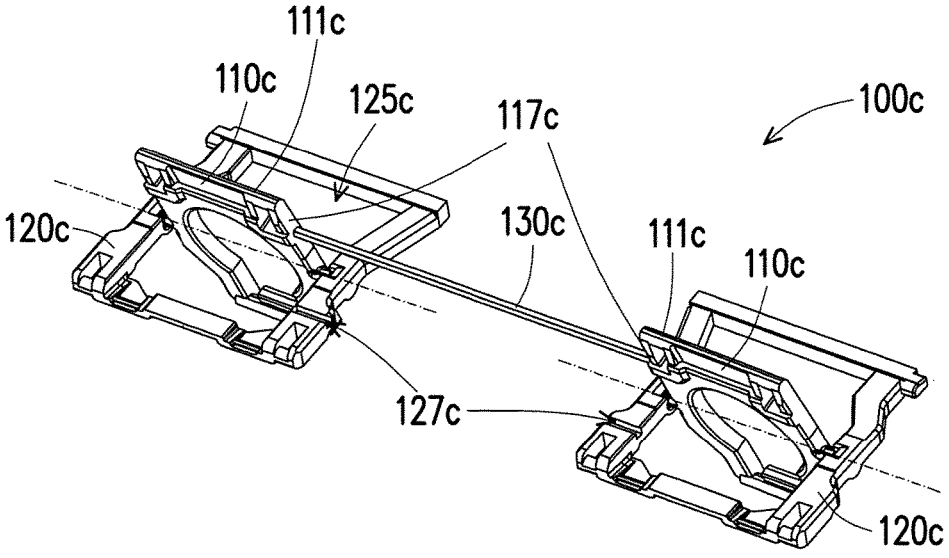
FIG. 15 is a schematic diagram illustrating pivotal rotation of second support frames relative to first support frames of the key support mechanism of FIG. 14.

FIG. 14 is a schematic diagram illustrating a key support mechanism 100*c* according to another embodiment of the invention. FIG. 15 is a schematic diagram illustrating pivotal rotation of second support frames 120*c* relative to first support frames 110*c* of the key support mechanism 100*c* of FIG. 14. Referring to FIG. 14 and FIG. 15, a main difference between the embodiment of FIG. 14 and the embodiment of FIG. 10 lies in that a first connecting member 130*c* is connected to an inner side 117*c* of the first support frame 110*c* functioning as the inner scissors. As shown in FIG. 15, the second support frame 120*c* functioning as the outer scissors has a corresponding recess 127*c* at a portion where the first connecting member 130*c* passes to allow space for the first connecting member 130*c* to pass through.

It shall be mentioned that the foregoing embodiments illustrate that the first connecting members 130*a*, 130*b*, 130*c* may be connected to different positions of the first support frames 110*a*, 110*b*, 110*c* functioning as the inner scissors. Similarly, if the first connecting member is connected to the first support frames functioning as the outer scissors, it may also be connected to positions other than that shown in FIG. 7 and may still achieve the linking effect, which shall not be repeatedly described here.

Figure 16:
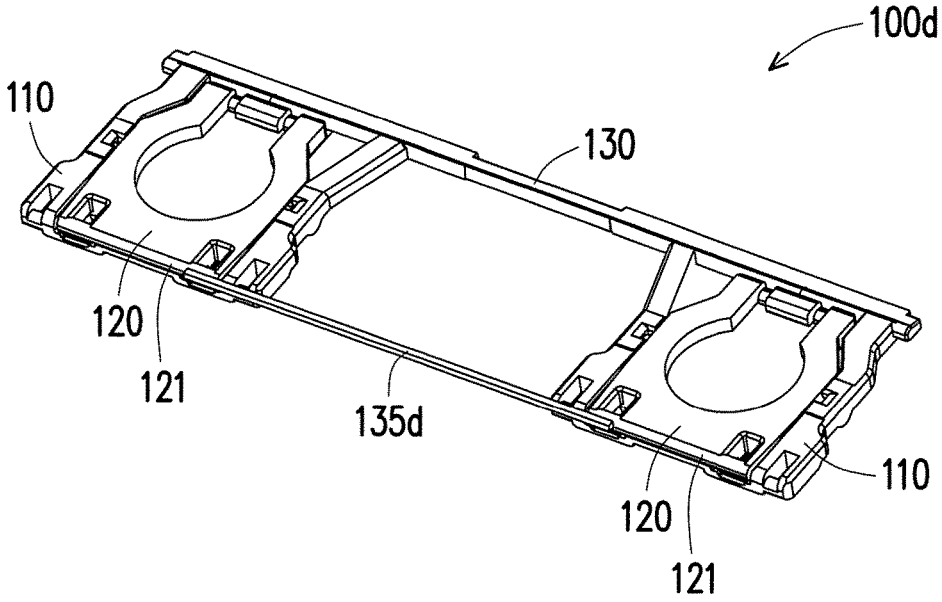
FIG. 16 is a schematic diagram illustrating a key support mechanism according to another embodiment of the invention.
Figure 17:
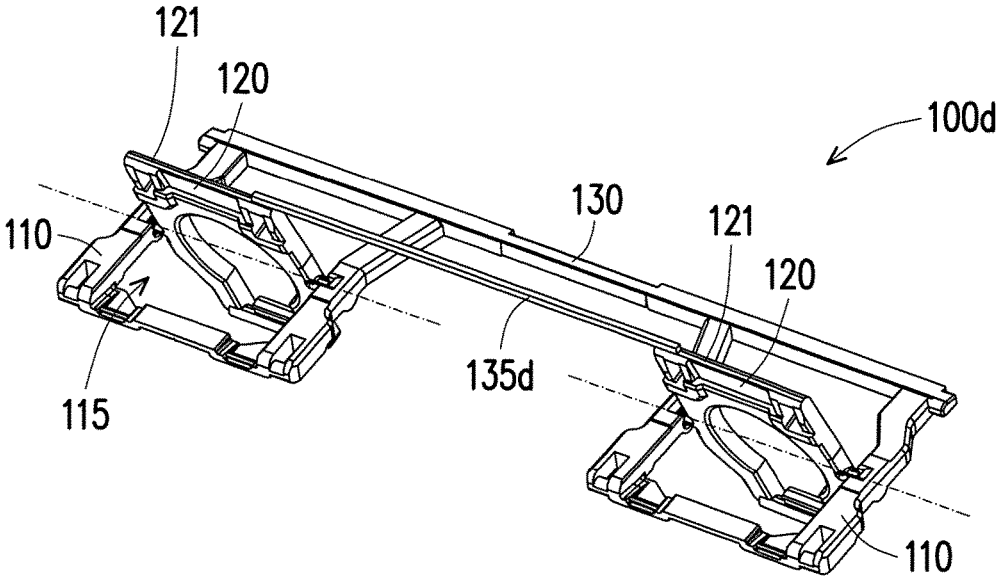
FIG. 17 is a schematic diagram illustrating pivotal rotation of second support frames relative to first support frames of the key support mechanism of FIG. 16.

FIG. 16 is a schematic diagram illustrating a key support mechanism 100*d* according to another embodiment of the invention. FIG. 17 is a schematic diagram illustrating pivotal rotation of the second support frames 120 relative to the first support frames 110 of the key support mechanism 100*d* of FIG. 16. Referring to FIG. 16 and FIG. 17, a main difference between the embodiment of FIG. 16 and the embodiment of FIG. 7 lies in that, in the present embodiment, the key support mechanism 100*d* further includes a second connecting member 135*d*. The second connecting member 135*d* is connected to the two second support frames 120 functioning as the inner scissors, and the second connecting member 135*d* is close to the two third sides 121 of the two second support frames 120 to link the two third sides 121 of the two second support frames 120 to each other. In other words, in the present embodiment, the key support mechanism 100*d* not only connects the two first support frames 110 through the first connecting member 130, but also connects the two second support frames 120 through the second connecting member 135*d* so as to provide a better linking effect.

In summary of the above, the key support mechanism of the key module of the invention includes the two scissor structures. The key support mechanism connects the two first support frames of the two scissor structures through the first connecting member, and the first connecting member is close to the two first sides of the two first support frames, such that the two first sides of the two first support frames connected to the keycap are linked to each other. Accordingly, when one of the edges of the keycap is pressed down, the first side of the first support frame below this edge is moved downward, which causes the first connecting member to move downward jointly and drives the first side of the first support frame below the other edge to move downward. Therefore, the two first support frames of the two scissor structures move together such that the keycap can move together in its entirety. As a result, the keycap can effectively press downward the elastic member located between the two scissor structures and trigger the switch. The key support mechanism of the key module of the invention exhibits advantages of structural simplicity, low costs, and ease of assembly. Moreover, since the first connecting member is fixed to the two first support frames, the first connecting member does not move relatively to the two first support frames. When the key module is pressed, the first connecting member does not hit the keycap or the base plate due to unwanted shaking and cause noise, and a more comfortable use experience is created.

Although the invention is disclosed as the embodiments above, the embodiments are not meant to limit the invention. Any person skilled in the art may make slight modifications and variations without departing from the spirit and scope of the invention. Therefore, the protection scope of the invention shall be defined by the claims attached below.

What is claimed is:

1. A key module comprising:

a base plate;

a circuit membrane disposed on the base plate and comprising a switch;

an elastic member disposed on the switch;

a key support mechanism disposed on the circuit membrane, the key support mechanism comprising:

two scissor structures, wherein the elastic member is located between the two scissor structures, and the two scissor structures respectively comprise:

two first support frames, each of the first support frames comprising a first side and a second side opposite to each other, a first fixing part located on the first side, and a second fixing part located on the second side, wherein the two second fixing parts are respectively fixed to the base plate;

two second support frames respectively pivotally connected to the two first support frames, each of the second support frames comprising a third side and a fourth side opposite to each other, a third fixing part located on the third side, and a fourth fixing part located on the fourth side, wherein the two fourth fixing parts are respectively fixed to the base plate; and a first connecting member fixed and connected to the two first support frames and located close to the two first sides, such that the two first support frames of the two scissor structures are linked to each other; and a keycap covering the elastic member and the key support mechanism, wherein the two first fixing parts of the two first support frames and the two third fixing parts of the two second support frames are respectively fixed to the keycap, wherein the two first support frames and the first connecting member are integrally formed.

2. The key module according to claim 1, wherein each of the first support frames comprises a first slot, and each of the second support frames is adapted to be pivotally rotated into the first slot of the corresponding first support frame.

3. The key module according to claim 1, wherein each of the second support frames comprises a second slot, and each of the first support frames is adapted to be pivotally rotated into the second slot of the corresponding second support frame.

4. The key module according to claim 1, wherein the key support mechanism further comprises:

a second connecting member fixed and connected to the two second support frames and located close to the two third sides, such that the two second support frames of the two scissor structures are linked to each other.

5. A key support mechanism adapted to be disposed between a base plate and a keycap, the key support mechanism comprising:

two scissor structures respectively comprising:

two first support frames, each of the first support frames comprising a first side and a second side opposite to each other, a first fixing part located on the first side, and a second fixing part located on the second side, wherein the two first fixing parts are respectively adapted to be fixed to the keycap, and the two second fixing parts are respectively adapted to be fixed to the base plate; and two second support frames respectively pivotally connected to the two first support frames, each of the second support frames comprising a third side and a fourth side opposite to each other, a third fixing part located on the third side, and a fourth fixing part located on the fourth side, wherein the two third fixing parts are respectively adapted to be fixed to the keycap, and the two fourth fixing parts are respectively adapted to be fixed to the base plate; and a first connecting member fixed and connected to the two first support frames and located close to the two first sides, wherein the two first support frames and the first connecting member are integrally formed, such that the two first support frames of the two scissor structures are linked to each other.

6. The key support mechanism according to claim 5, wherein each of the first support frames comprises a first slot, and each of the second support frames is adapted to be pivotally rotated into the first slot of the corresponding first support frame.

7. The key support mechanism according to claim 5, wherein each of the second support frames comprises a second slot, and each of the first support frames is adapted to be pivotally rotated into the second slot of the corresponding second support frame.

8. The key support mechanism according to claim 5, further comprising:

a second connecting member fixed and connected to the two second support frames and located close to the two third sides, such that the two second support frames of the two scissor structures are linked to each other.

* * * * *